US008544686B2

(12) United States Patent
Williams

(10) Patent No.: US 8,544,686 B2
(45) Date of Patent: Oct. 1, 2013

(54) SYSTEM FOR DISPENSING SPRAYABLE MATERIAL

(75) Inventor: Mark D. Williams, Minden, NV (US)

(73) Assignee: Aervoe Industries, Inc., Gardnerville, NV (US)

( * ) Notice: Subject to any disclaimer, the term of this patent is extended or adjusted under 35 U.S.C. 154(b) by 466 days.

(21) Appl. No.: 12/831,263

(22) Filed: Jul. 7, 2010

(65) Prior Publication Data

US 2011/0006076 A1 Jan. 13, 2011

Related U.S. Application Data

(60) Provisional application No. 61/270,568, filed on Jul. 10, 2009, provisional application No. 61/270,620, filed on Jul. 10, 2009, provisional application No. 61/270,621, filed on Jul. 10, 2009.

(51) Int. Cl.
*B65D 35/28* (2006.01)

(52) U.S. Cl.
USPC ..... 222/95; 222/105; 222/325; 222/326; 222/386; 222/391; 222/402.1; 222/402.15

(58) Field of Classification Search
USPC ..... 222/1, 95, 105, 325–327, 333, 386, 222/391, 402.15, 183, 402.1, 394, 162
See application file for complete search history.

(56) References Cited

U.S. PATENT DOCUMENTS

| | | | | |
|---|---|---|---|---|
| 3,443,725 | A * | 5/1969 | Lawhorn | 222/79 |
| 3,799,407 | A * | 3/1974 | Loethen et al. | 222/333 |
| 4,193,513 | A * | 3/1980 | Bull, Jr. | 222/1 |
| 4,299,336 | A * | 11/1981 | Studer | 222/80 |
| 4,516,696 | A * | 5/1985 | Eknor | 222/181.2 |
| 4,685,595 | A * | 8/1987 | Segatz | 222/326 |
| 4,998,645 | A * | 3/1991 | Pearson | 222/98 |
| 5,153,820 | A * | 10/1992 | MacFarlane et al. | 361/525 |
| 5,323,931 | A * | 6/1994 | Robards et al. | 222/96 |
| 5,443,181 | A * | 8/1995 | Popp et al. | 222/95 |
| 5,560,518 | A * | 10/1996 | Catterall et al. | 222/99 |
| 6,966,461 | B2 * | 11/2005 | Warner et al. | 222/174 |
| 7,314,149 | B1 * | 1/2008 | White | 222/174 |

* cited by examiner

*Primary Examiner* — Frederick C Nicolas

(57) ABSTRACT

A system for dispensing sprayable material such as paint and other liquefied products. The system includes a dispenser designed to accept a flexible, crushable, container filled with sprayable material and having a valve and spray tip at one end. The container is placed into a slot in the dispenser with the valve on the container secured in the housing of the dispenser. In operation, a plunger that runs lengthwise within the housing of the dispenser exerts force on the bottom of the container crushing it as it is emptied and forcing the sprayable material out through the valve and spray tip.

18 Claims, 11 Drawing Sheets

SYSTEM FOR DISPENSING SPRAYABLE MATERIAL

RELATED U.S. APPLICATION DATA

Provisional application No. 61/270,568 filed on Jul. 10, 2009; provisional application No. 61/270,620 filed on Jul. 10, 2009; and, provisional application No. 61/270,621 filed on Jul. 10, 2009.

BACKGROUND

Aerosol cans for depositing paint and other sprayable materials have been in use for some time. The term "aerosol" as used herein refers to a suspension of liquid or solid particles in a gas. Most aerosol cans are made of tin-plated steel or aluminum. Once an aerosol can has been used and emptied in any of its many possible applications such as for food, beverage, paint and aerosol products, it is in need of recycling. There are over three billion aerosol cans manufactured in the U.S. annually. Many of the products contained in these cans, such as paint products, light lubricants, starting fluids, polishes and waxes, and cleaners, contain substantial amounts of volatile organic compounds (VOCs) as solvents and include flammable propellants. As a result, partially empty aerosol cans are treated as a hazardous waste at collection centers, military bases, industries utilizing large quantities of aerosols, and treatment, storage, and disposal facilities. Typically, an aerosol package consists of a pressurized liquid product packaged inside a hermetically sealed can that is dispensed through a push button spray tip/valve combination. The pressure is created in the aerosol can via a propellant that atomizes the chemical contents and creates the force to easily dispense the product through the valve/tip in a cost effective manner. The spray delivery which is efficient and effective is commonly used across a wide array of products. The hermetic seal saves the product from contamination during storage.

Some specialized products use a bag or container inside a pressurized can. The liquid product is stored inside the bag and the propellant is inside the space in the can surrounding the bag. The propellant creates pressure on the bag to force the product through the spray tip/valve system for use. This type of aerosol packaging can be expensive and redundant and is typically used in creams and lotions. Given the public's concern about solid waste disposal, the aerosol industry teamed with the steel industry to promote the collection of empty aerosol cans in recycling programs nationwide. Thousands of communities now include aerosol product recycling in both household residential and curbside buy-back and drop-off programs. However, solid waste management firms are questioning the potential safety hazards of processing even 'empty' aerosols. This safety question is primarily due to the highly flammable propellants still contained in many cans even when the liquid contents are discharged.

There have been extensive efforts to find alternative solutions to aerosol cans, many of which have proven unsatisfactory. The use of aerosol bags without the can is an option that has not been previously addressed in the prior art. The rigid exterior of a can has been considered essential because of safety concerns for a user in the event that an aerosol bag bursts, causing injury from the propellant materials contained inside the can, or the possibility of fire fueled by these materials. An enormous amount of resources are expended to manufacture cans, collect empty cans, and recycle the empty cans. As a result, it would be highly beneficial to find a solution for deploying aerosol bags but without the can and the propellant. Such a solution would eliminate flammability concerns during dispensing, while still providing the performance results of a spray can application.

The present invention is a system that utilizes a flexible, crushable container similar to the type of container used in some aerosol products, although in this case without a surrounding can and propellant. A dispenser having an elongated housing is provided for receiving the bag. The dispenser is a gun type device that uses a plunger to apply force to the bottom of the bag while the top of the bag with the valve and spray tip is held securely in a slot or valve seat in the other end of the housing. The force exerted by the plunger within the housing creates the hydrostatic pressure inside the bag needed to spray the product through the valve and spray tip. A first trigger and handle on the device are squeezed together to exert force on the plunger. This, in turn, compresses a container spring creating the hydrostatic pressure inside the bag. The user then pulls a second trigger, which activates the valve and dispenses the product. As the product is dispensed, the bag collapses and the container spring extends to its free length. At this point there is little or no pressure on the bag. In a mechanical version of the system, the user renews the cycle by squeezing the first trigger and handle to move the plunger while compressing the container spring and re-creating the hydrostatic pressure needed to dispense remaining product from the bag. The user again pulls the second trigger to dispense the product. This cycle is repeated until the bag is emptied.

BRIEF DESCRIPTION OF THE DRAWINGS

For a better understanding of the present invention, and to show more clearly how it functions, reference will now be made, by way of example, to the accompanying drawings. The drawings show preferred embodiments of the present invention in which.

DETAILED DESCRIPTION OF THE INVENTION

Figure 1:
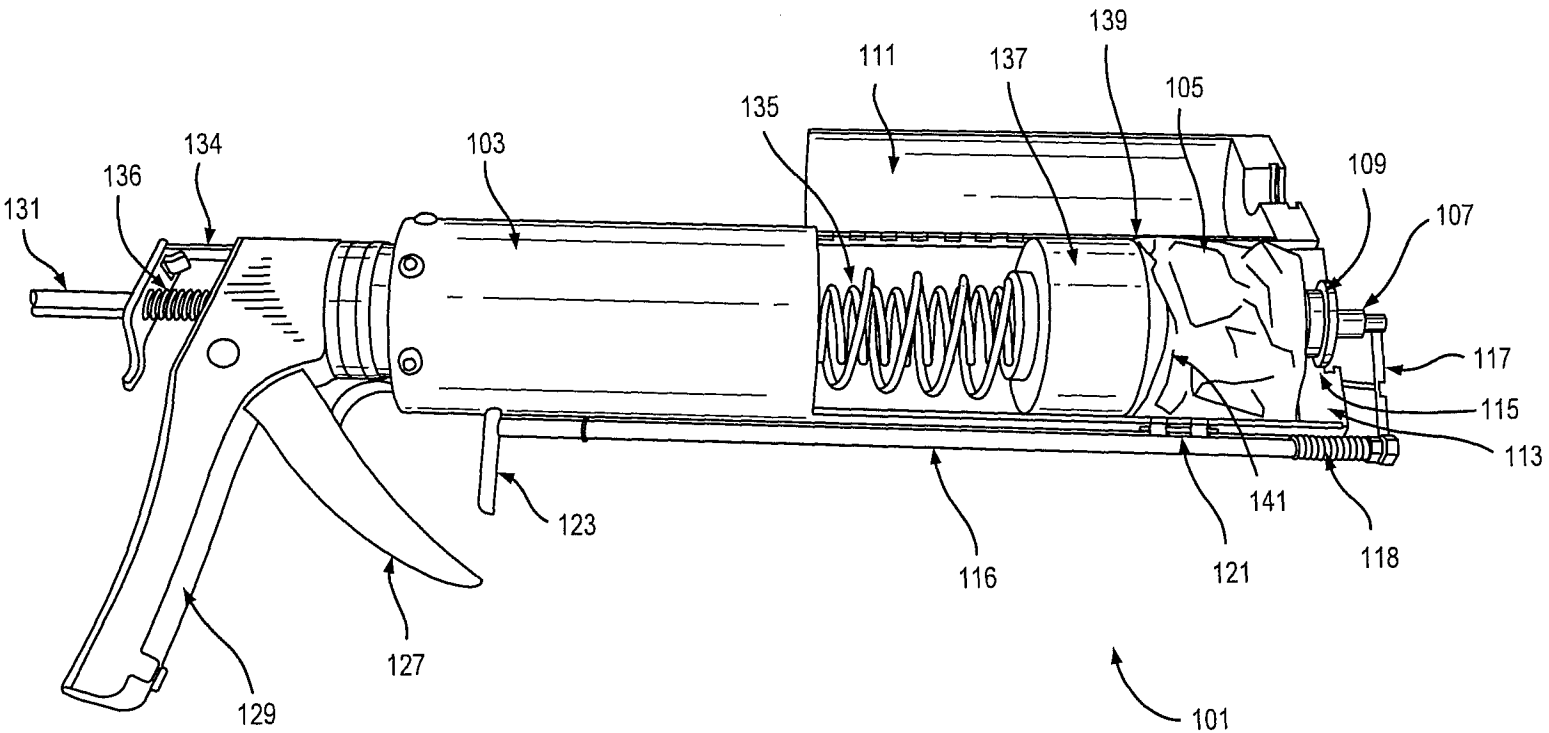
FIG. 1 is a side exterior view of a first embodiment of the dispenser of the system of the present invention.

The present invention will now be described more fully with reference to the accompanying drawings. It should be understood that the invention may be embodied in many different forms and should not be construed as limited to the embodiments set forth herein. Throughout FIGS. 1-11, like elements of the invention are referred to by the same reference numerals for consistency purposes.

Figure 2:
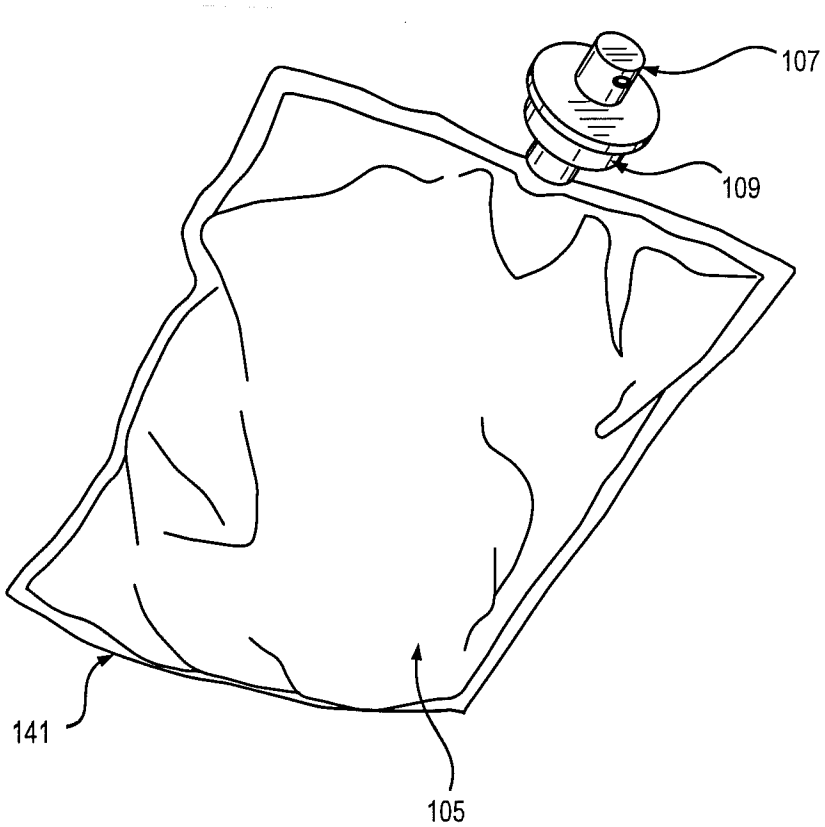
FIG. 2 is a side exterior view of a first embodiment of a crushable container with a valve and spray tip.
Figure 3:
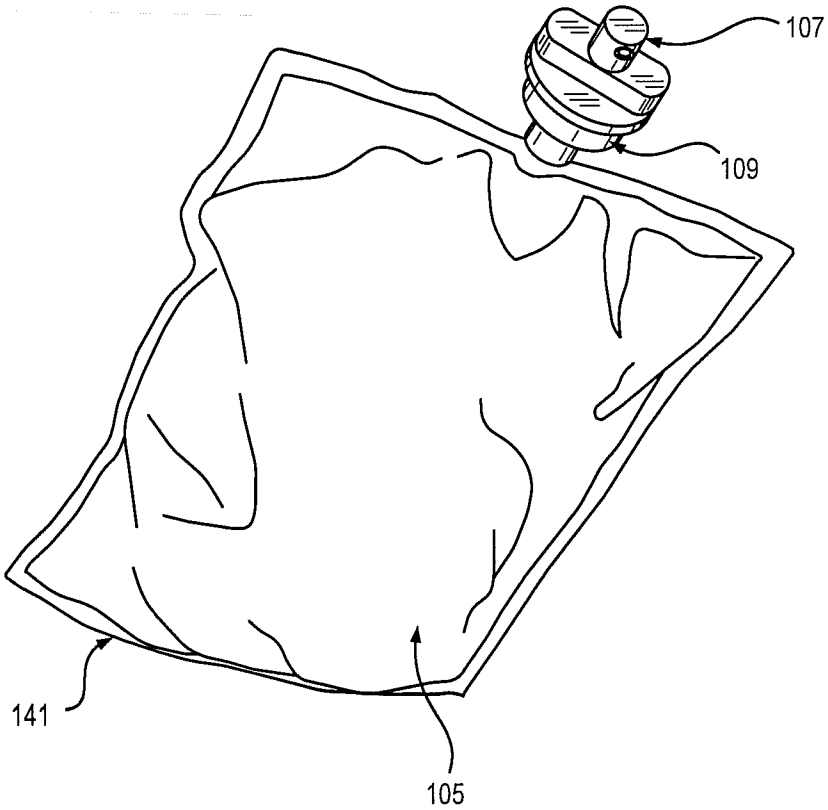
FIG. 3 is a side exterior view of a second embodiment of a crushable container with a valve and spray tip.
Figure 4:
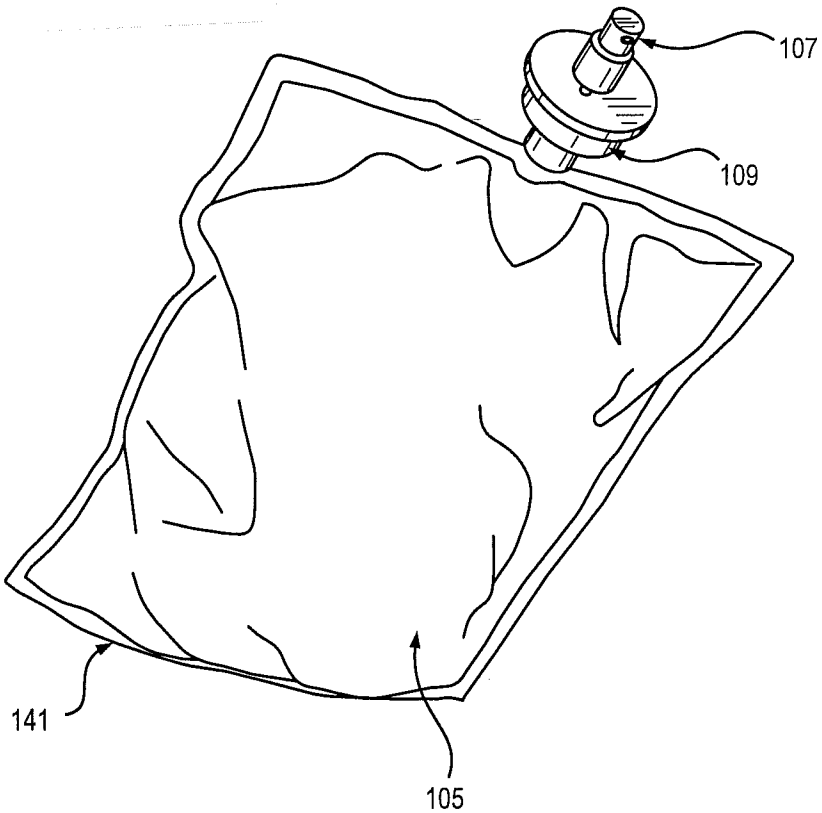
FIG. 4 is a side exterior view of a third embodiment of a crushable container with a valve and spray tip.

FIGS. 1-11 show various views of a dispenser system 101 with a dispenser in the general shape of a gun. Elongated cylinder shaped housing 103 is configured to receive a flexible bag or flexible container 105. Container 105 is shown in FIGS. 2-4 with three different valve and tip embodiments, although there are other embodiments that would work with dispenser system 101 as well.

Container 105 is sealed, and is filled with a sprayable liquid material such as paint. At one end of container 105 is a cap area that has a spray tip 107 situated at the end of a valve 109. Valve 109 is attached to container 105. Spray tip 107 can be of different types. FIG. 2 shows spray tip 107 with a side spray configuration. This type of spray tip is activated by pushing down and to the side and is also referred to as a triangle tilt configuration. FIGS. 3 and 4 show other spray tip types that are both activated by depressing the tip downward in a direction towards the body of bag 105.

Referring to FIGS. 1 and 5-11, container 105 is placed in housing 103 with valve 109 seated in valve seat 113 that is set in the forward end of housing 103. In FIG. 1, spray tip 107 is the depress-activated type like that shown in FIG. 4. A hinged panel 111 matching the shape of housing 103 opens to allow housing 103 to receive container 105 and closes once container 105 has been placed inside. Valve seat 113 is shaped to keep valve 109 in an immobilized state during operation of dispenser 101 with fingers 115 extending on either side of valve 109.

Alternative embodiments for activating spray tip 107 are contemplated and will be apparent to one skilled in the art. In the embodiments shown in FIGS. 5-11, trigger rod 117 makes contact with the forward surface of valve seat 113 and is attached to trigger plate 119. Trigger plate 119 is a substantially triangular flat component that provides a mounting point at each of its three corners. While trigger rod 117 is attached to one mounting point, the second mounting point is attached to trigger bracket 121. The third mounting point of trigger plate 119 is attached to spray trigger 123. Trigger pin 125 secures trigger rod 117 such that, when a user pulls spray trigger 123, trigger rod 117 pulls back spray tip 107 thereby allowing the pressurized contents of container 105 to spray through valve 109 and spray tip 107, and deliver the contents of container 105 as needed.

In an alternative embodiment for activating spray tip 107 shown in FIG. 1, spray trigger 123 can be mounted along the bottom of dispenser housing 103. Instead of using trigger plate 119 and trigger bracket 121, a design using a trigger extender 116, trigger rod 117 and trigger rod spring 118 could be used. Trigger rod 117 is mounted to the end of trigger extender 116. A trigger bracket 121 secures trigger extender 116 to housing 103. By pulling back on spray trigger 123, trigger extender 116 moves with trigger 123 to pull back on trigger rod 117. This action pushes down on spray tip 107 releasing the materials from container 105.

A combination of a plunger trigger 127 and a handle 129 is used to apply a load to the bottom of container 105. Plunger trigger 127 and handle are in a hinged configuration that is squeezed together to cause a pumping action that applies pressure to container 105. The pumping action drives a plunger 131 that has progressive ratchet notches 133 along its length. A plunger bracket 134 is affixed to the housing for keeping plunger 131 in place and a plunger spring biases the plunger in position relative to housing bracket 134. Pressure on container 105 can be re-applied as plunger 131 moves along its length and is re-engaged in the progressive notches as needed when pressure inside container 105 drops below an acceptable level. By repeatedly squeezing plunger trigger 127, a piston spring 135 that sits between housing 103 and plunger bracket 134 is compressed and pressed forward against a piston (or force platen) 137. Piston 137 is substantially flat on both sides and being of large enough width and mass to apply pressure on container 105 while maintaining its shape. The front surface 139 of piston 137 presses against a bottom surface 141 of container 105 with piston 137 being held in place by a surrounding interior surface 143 of housing 103. It is contemplated that during use of dispenser 101, a user alternates between pulling spray trigger 123 to dispense the contents of container 105 as needed, and pumping plunger trigger 127 to restore pressure to container 105.

Figure 6:
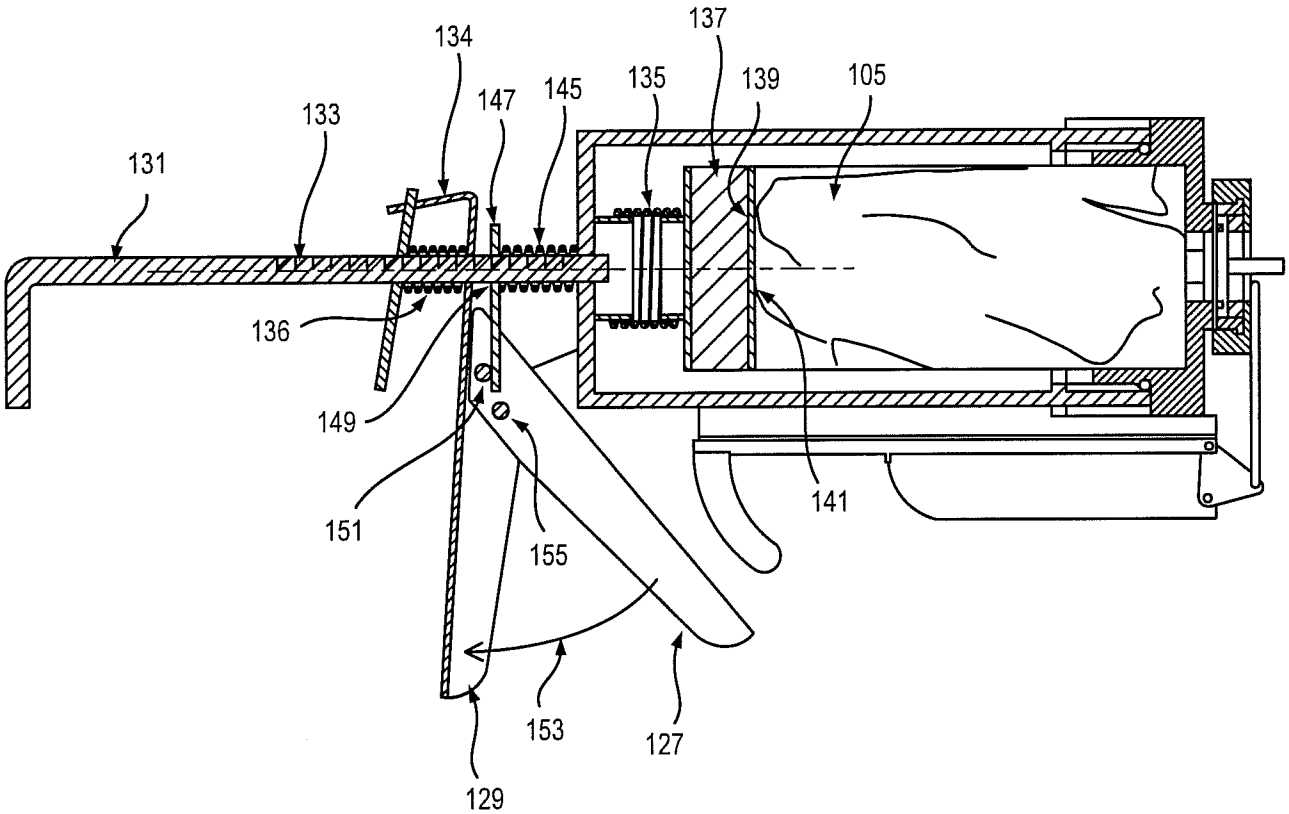
FIG. 6 is an exploded cross-sectional view of the plunger and associated components of the present invention wherein the plunger trigger is shown in an open position in the second embodiment.

A configuration for ratcheting plunger 131 is shown in FIG. 6. A biasing spring 145 and a jam plate 147 having a hole 149 for receiving the plunger 131 are shown. Jam plate 147 is disposed about plunger 131 and rests against an inside surface of handle 127 and a driving pin 151 attached to plunger trigger 127. Biasing spring 145 urges jam plate 147 away from housing 103 so that it is pressed against driving pin 151 and plunger trigger 127

Figure 7:
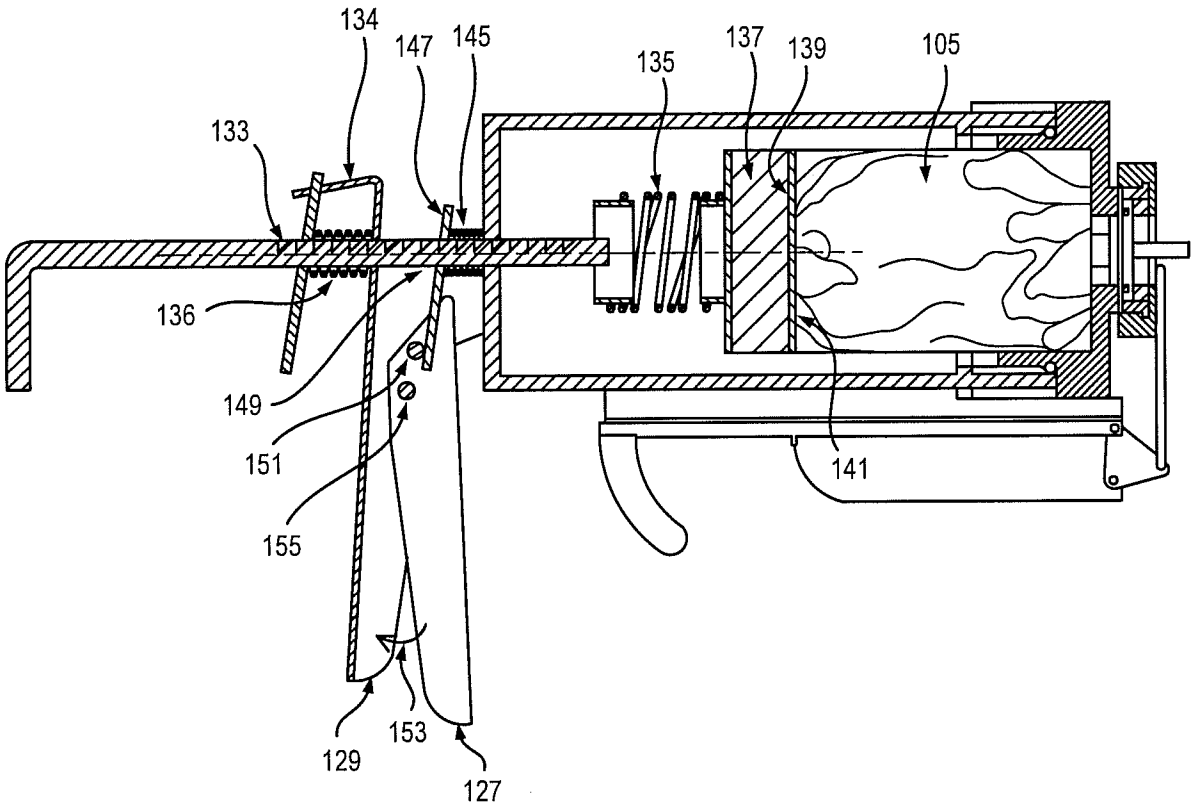
FIG. 7 is an exploded cross-sectional view of the plunger and associated components of the present invention wherein the plunger trigger is shown partially depressed in the second embodiment.

A description of the operation of the biased-spring 145 is as follows: handle 129 is depressed in the direction of arrow 153, pivoting about pivot pin 155 so that driving pin 151 moves the lower edge of jam plate 147 forward, toward housing 103. This causes the jam plate to cant so that it jams on one of the notches 133 along the length of plunger 131. Then, as plunger trigger 127 is moved further in the direction of arrow 153, jam plate 147 and plunger 131 move together towards housing 103. FIG. 7 shows plunger trigger 127 in the fully depressed state.

Figure 5:
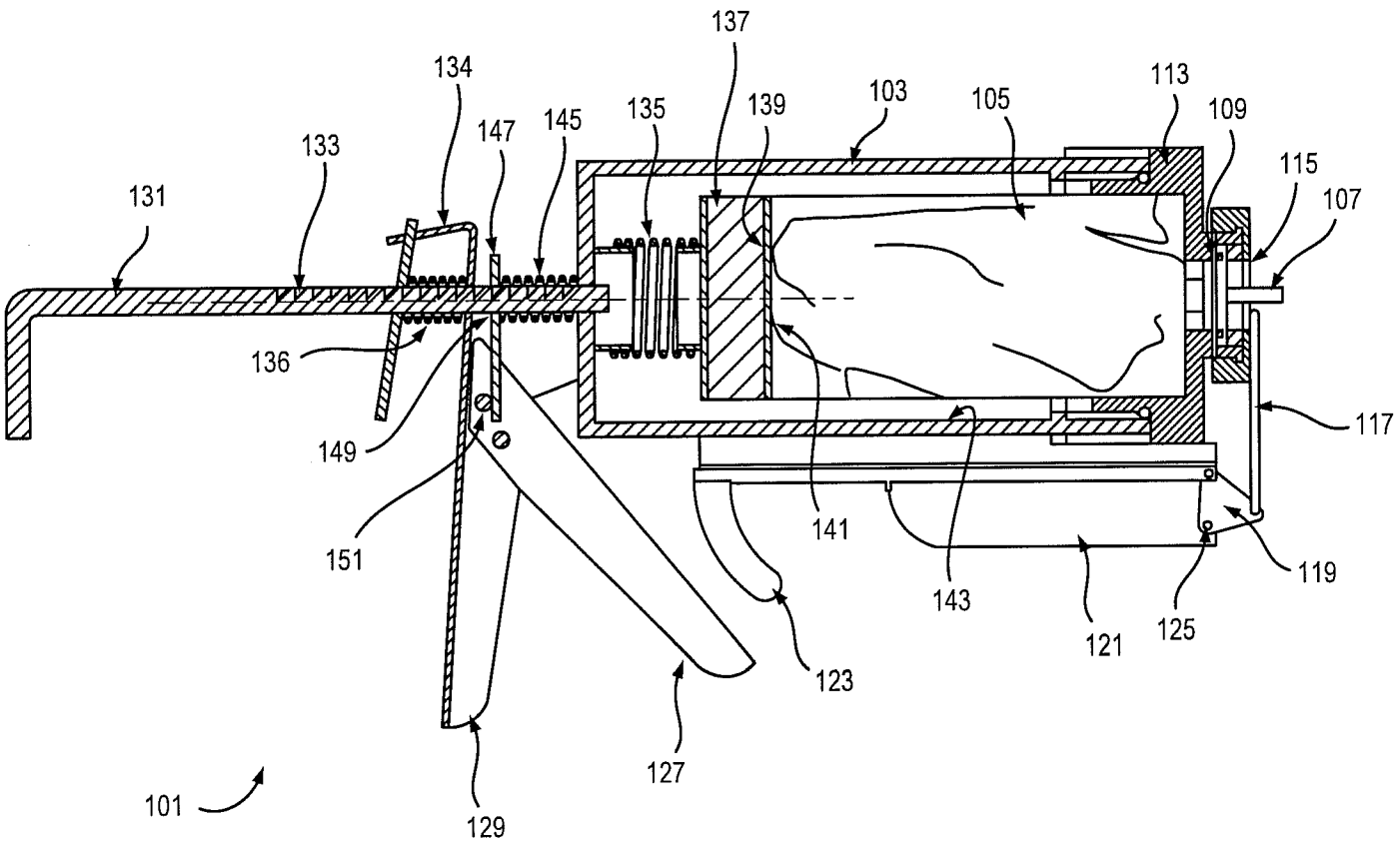
FIG. 5 is a cross-sectional view showing the internal components of the present invention in a second embodiment.
Figure 8:
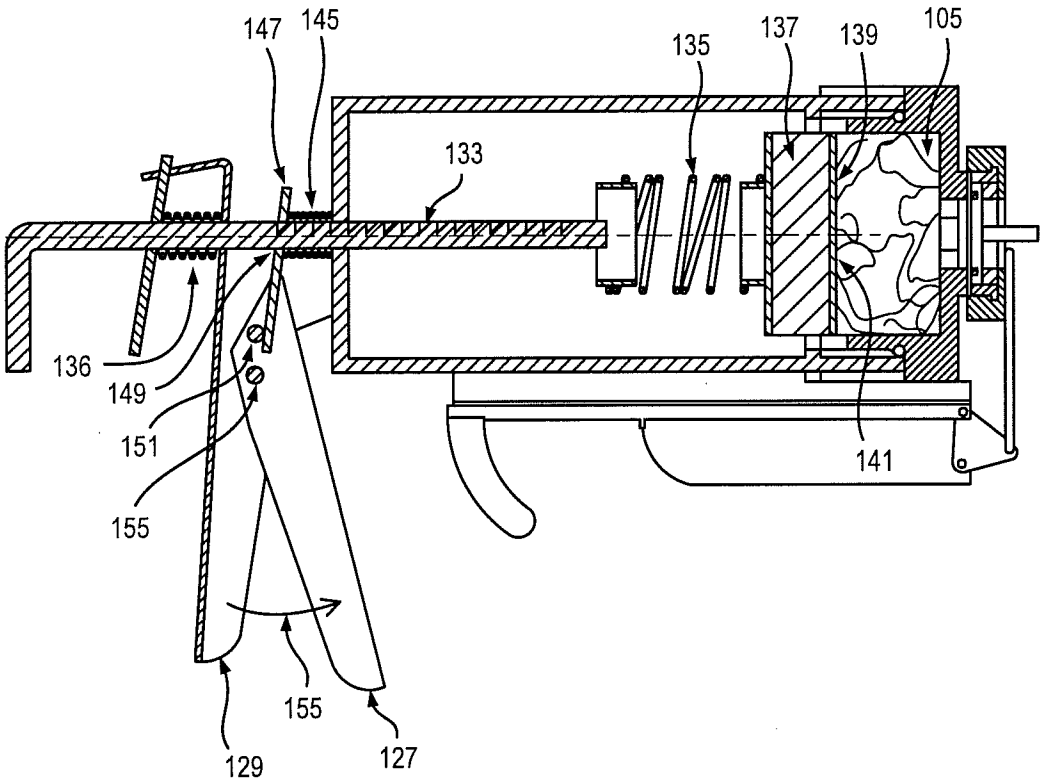
FIG. 8 is an exploded cross-sectional view of the plunger and associated components of the present invention wherein the plunger trigger has been released in the second embodiment.

When plunger trigger 127 is released it moves in the direction of arrow 155, as shown in FIG. 8. Jam plate 147 and plunger 131 move backward, together, away from housing 103. When plunger trigger 127 is fully released, jam plate 147 again rests against the inside surface of handle 129 and driving pin 151, having been moved back into position by biasing spring 145. With plunger trigger 127 fully released, as shown in FIG. 5 there is no resistance on plunger 131 and it slides freely through handle 129, jam plate 147, biasing spring 145, and housing 103.

The action of plunger 131 drives piston 137 against bottom surface 141 of container 105 crushing it from the bottom up as piston 137 moves along inside housing 103. As noted above, piston 137 is preferably a solid disk shape with a width large enough to prevent it from bending or otherwise causing it to become misshapen as it exerts force on container 105. Piston 137 may be made of metal, plastic or other materials that hold their shape. The operative features of piston 137 will now be described.

As described above, operation of plunger trigger 127 in the direction of arrow 153 moves plunger 131 while simultaneously compressing piston spring 135 from the plunger side and allowing piston spring 135 to extend in the direction of piston 137 to push piston 137 against bottom surface 141 of container 105. As shown in FIG. 6 and FIG. 7, moving plunger 131 in the direction of container 105 causes piston 137 to contact and exert force on container 105 crushing it as piston 137 slides along the inside of housing 103. The crushing action on container 105 continues as piston spring 135 and piston 137 move in unison along the inside of housing 103. In addition to having a width permitting it to maintain its shape, piston 137 is also designed in a cylindrical shape to fit snugly within the cylindrical interior portion of housing 103. Interior surface 143 of housing 103 acts as a guide for piston 137 to keep it in place as it moves inside housing 103.

While forming housing 103 and piston 137 in a cylindrical shape has been proven to work, it is also possible that housing 103 and piston 137 could take on other shapes provided they are compatible. Interior surface 143 of housing 103 functions as a guide for piston 137 as the sidewalls of piston 137 contact interior surface 143 during operation of dispenser 101. It should also be noted that housing 103 works best when fully enclosed. One embodiment that is shown in the figures includes hinged panel 111 that is closed once container 105 is seated within housing 103. A hinge works well to ensure proper positioning of panel 111 and to prevent loss of panel 111 when it is open during loading of container 105. However, panel 111 could be removable without a hinge using tabs or other components to keep it in place. Or, slots could be cut in the side of housing 103 to allow the user to have a view of container 105 during operation so that a user can determine when container 105 is empty or nearly empty.

Figure 9:
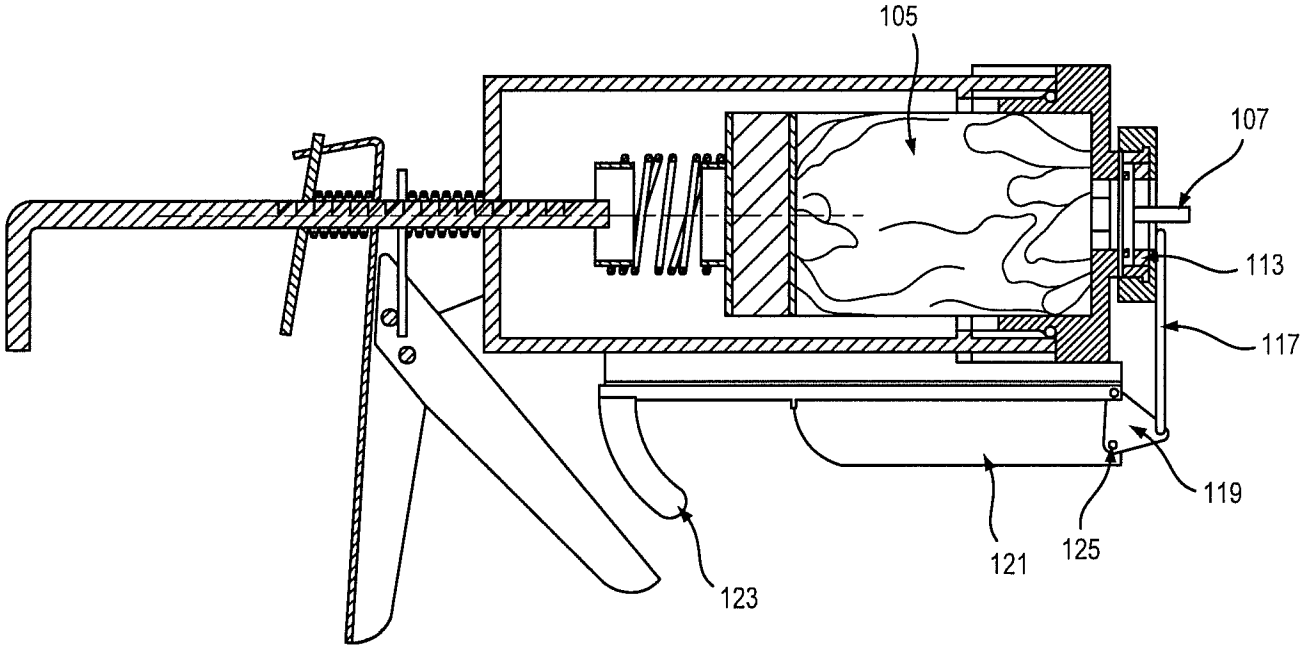
FIG. 9 is an exploded cross-sectional view of the spray trigger and associated components of the present invention where the spray trigger is in an initial state in the second embodiment.

Once plunger 131 is locked in place, jam plate 147 engages one of notches 133 along plunger 131 and container 105 is under pressure from piston 137 as it exerts force against bottom surface 141 of container 105. Container 105 is ready to release its contents through spray tip 107 as shown in FIG. 9.

Figure 10:
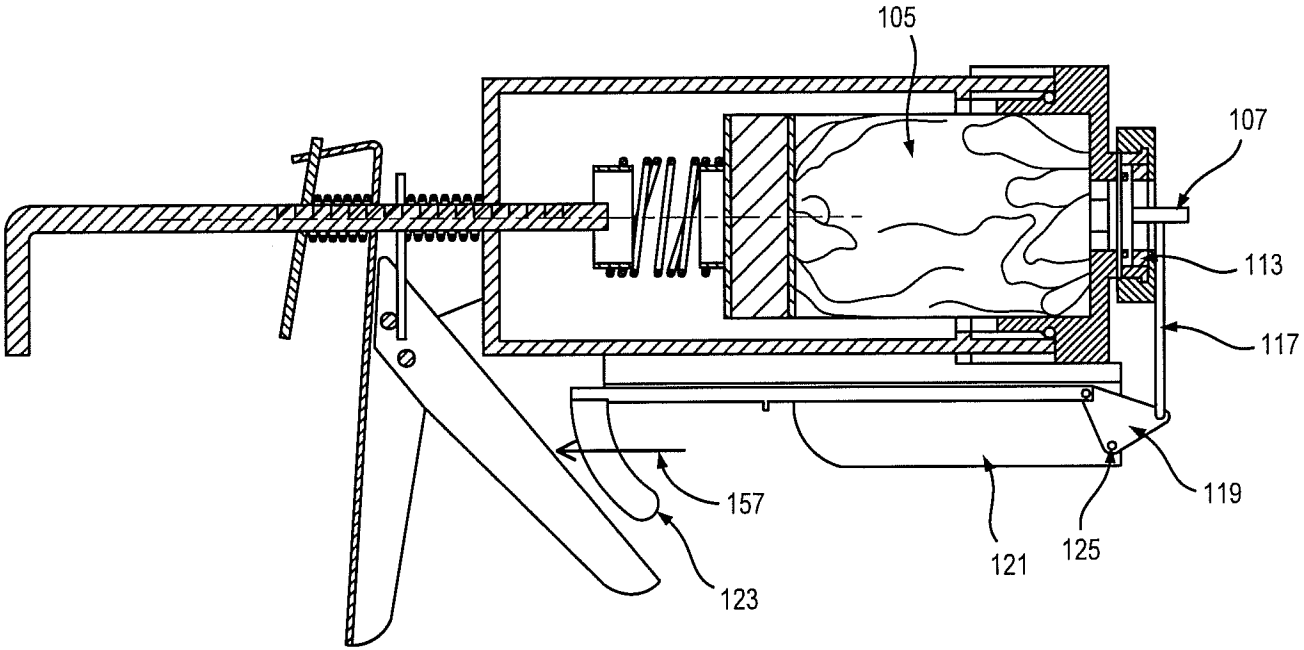
FIG. 10 is an exploded cross-sectional view of the spray trigger and associated components of the present invention where the spray trigger is has been released in the second embodiment.

To operate spray tip 107, a user pulls spray trigger 123 as shown in FIG. 10 in the direction of arrow 157. Trigger rod 117 contacts the forward surface of valve seat 113 and is attached to trigger plate 119. Trigger plate 119 is a substantially triangular flat component that provides a mounting point at each of its three corners. While trigger rod 117 is attached to one mounting point, the second mounting point is attached to trigger bracket 121. The third mounting point of trigger plate 119 is attached to spray trigger 123. Trigger pin 125 secures trigger rod 117 such that, when a user pulls spray trigger 123, trigger rod 117 pulls back spray tip 107, thereby allowing the pressurized contents of container 105 to spray through valve 109 and spray tip 107, and deliver the contents of container 105 as needed. There are many ways to design spray trigger 123 to cause spray tip 107 to open and release the contents of container 105 depending on the type of spray tip used. Two embodiments have been described herein, but many others would be apparent to one skilled in the art.

Figure 11:
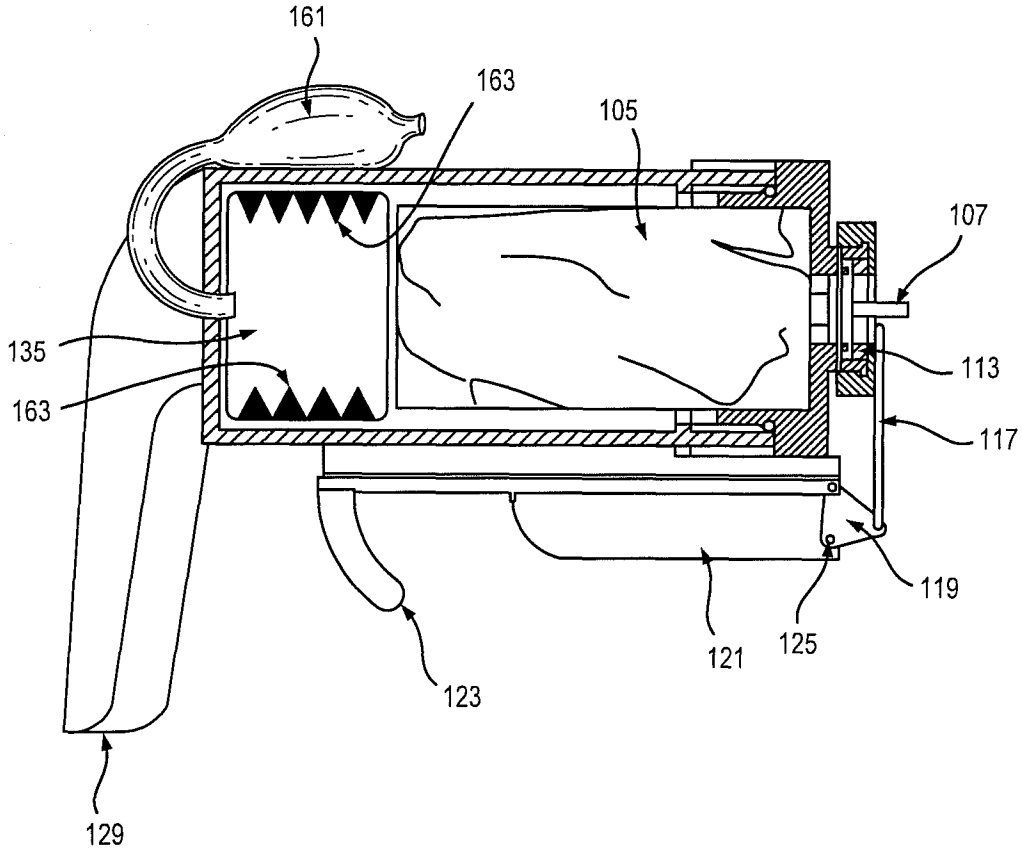
FIG. 11 is a side exterior view of a third embodiment of the dispenser system of the present invention using an air bladder.

While the invention has been described with respect to the figures, it will be appreciated that many modifications and changes may be made by those skilled in the art without departing from the spirit of the invention. Any variation and derivation from the above description and drawings are included in the scope of the present invention as defined by the claims. For example, in the alternative, dispenser 101 may be implemented using an electric or battery powered plunger and piston arrangement that may be adapted for use from the description of U.S. Pat. No. 6,123,235 to Hsu which is incorporated by reference herein. A battery powered plunger and piston of the type described by Hsu would eliminate the need to manually ratchet the plunger and piston configuration of the present invention. It is also possible to use a pump 161 and air bladder 159 in combination as shown in FIG. 11, or a compressed air cartridge power source to apply pressure to the piston and compress the container in place of the spring and plunger. By pumping up air bladder 159 with pump 161, air bladder 159 expands at expansion areas 163 to apply pressure directly to container 105 with the other components of the dispenser being as described above with respect to FIGS. 1-10.

What is claimed is:

1. A system for dispensing sprayable material comprising:
- a flexible container having a body, a bottom and a top forming an exterior surface and an interior space within which a material is housed and further comprising a spray tip mounted on a valve through which the sprayable material is sprayed;
- a dispenser configured to exerting pressure on the flexible container to force the sprayable material through the tip, the dispenser comprising:
  - an elongated housing formed with an interior portion;
  - a movable panel on the elongated housing wherein in an open position the interior portion is exposed through which the flexible container is placed in the interior portion, and in a closed position an interior surface of the housing and an interior surface of the movable panel form a rigid enclosure contacting the exterior surface of the flexible container and counteracting pressure exerted on the flexible container;
  - a fixed plate forming a first end of the housing with a valve seat in which the valve is seated;
  - a piston positioned inside the housing with a first end attached in slidable contact with the bottom of the container;
  - a plunger extending through a second end of the housing into the interior portion of the housing and attached to the piston;
  - a biasing element in movable connection with the piston wherein the biasing element biases the piston against the bottom of the container;
  - a handle attached to the housing;
  - a movable first trigger affixed to the housing, wherein movement of the first trigger slides the plunger within the housing exerting force on the bottom of the container; and
  - a moveable second trigger mounted to the housing, wherein movement of the second trigger opens the spray tip releasing the sprayable material from the container.

2. The system of claim 1 wherein the movable panel is a door that is hingably affixed to the housing.

3. The system of claim 1 wherein the flexible container is composed of a crushable material that is substantially completely expelled from the container as the flexible container is crushed without blocking an opening of the valve.

4. The flexible container of claim 1 further comprising a spray tip affixed to the top of the valve through which the sprayable material is dispersed as it exits the container.

5. The system of claim 1 wherein the biasing element comprises a spring.

6. The system of claim 1 wherein the biasing element comprises:
- an electric motor; and
- a gear driven by the electric motor that engages the plunger and maintains the force of the piston on the container.

7. A system for dispensing the contents of a flexible container comprising:
- an elongated housing formed with an interior portion;
- a movable panel on the elongated housing wherein in an open position the interior portion is exposed through which the flexible container is placed in the interior portion, and in a closed position an interior surface of the housing and an interior surface of the movable panel form a rigid enclosure contacting the exterior surface of the flexible container and counteracting pressure exerted on the flexible container;

a first end of the housing adapted to receive a valve of the container;

a piston positioned inside the housing in slideable contact with the bottom of the container;

a plunger positioned inside and along the length of the housing with a first end attached to the piston and the length passing through a second end of the housing;

a biasing element in movable connection with the piston, wherein the biasing element biases the piston against the bottom of the container;

a handle attached to the housing;

a movable first trigger affixed to the housing, wherein movement of the first trigger slides the plunger and the piston within the housing exerting force on the bottom of the container; and a movable second trigger affixed to the housing wherein movement of the second trigger opens the valve releasing material from the flexible container.

8. The system of claim 7 wherein the movable panel is a door hingably affixed to the housing.

9. The system of claim 7 wherein the flexible container is composed of a crushable material permitting the material to be substantially completely vacated from the container without blocking the valve opening.

10. The flexible container of claim 7 further comprising a spray tip affixed to the top of the valve through which the material is dispersed as it exits the flexible container.

11. The system of claim 7 wherein the biasing element comprises a spring.

12. The system of claim 7 wherein the biasing element comprises:

an electric motor; and a gear driven by the electric motor that engages the plunger and maintains the force of the piston on the container.

13. A method for dispensing the contents of a flexible container from a dispenser with an elongated housing into which the flexible container is placed, wherein the flexible container has a body, a bottom and a top forming an exterior surface and an interior space within which the contents are housed and a tip mounted on a valve through which the contents are dispensed, the method comprising:

receiving the flexible container through a movable panel in the elongated housing in an interior portion of the dispenser wherein in an open position of the movable panel, the interior portion is exposed through which the flexible container is placed in the interior portion, and in a closed position of the movable panel, an interior surface of the housing and an interior surface of the movable panel form a rigid enclosure contacting the exterior surface of the flexible container and counteracting pressure exerted on the flexible container;

seating the valve at a first end of the housing;

slidably contacting the bottom of the container with a piston positioned inside the housing;

positioning a plunger inside and along the length of the housing with a first end attached to the piston and a length of the plunger passing through a second end of the housing;

biasing the piston against the bottom of the container;

releasing a first trigger affixed to the housing that slides the plunger within the housing to exert force on the bottom of the container; and releasing a second trigger affixed to the housing opening the valve and releasing material from the container.

14. The method of claim 13 further comprising maintaining the top of the flexible container in place inside the rigid enclosure as the flexible container is crushed from the bottom by the piston.

15. The method of claim 13 wherein the movable panel is a door that is hingably affixed to the housing.

16. The method of claim 14 wherein the flexible container is composed of a crushable material that is substantially completely vacated from the container as the flexible container is crushed without blocking an opening of the valve.

17. The method of claim 13 wherein the flexible container further comprises a tip affixed to the top of the valve through which a sprayable material is dispersed as it exits the flexible container.

18. The method of claim 13 further comprising providing a motor on which a gear is mounted engaging the plunger and exerting force on the piston in contact with the flexible container.

* * * * *